United States Patent [19]

Wu

[11] 3,997,004

[45] Dec. 14, 1976

[54] METHOD FOR RECOVERING VISCOUS PETROLEUM

[75] Inventor: Ching H. Wu, Golden, Colo.

[73] Assignee: Texaco Inc., New York, N.Y.

[22] Filed: Oct. 8, 1975

[21] Appl. No.: 620,667

[52] U.S. Cl. ..... 166/251; 166/252; 166/258; 166/269; 166/272

[51] Int. Cl.[2] ..... E21B 43/24

[58] Field of Search ..... 166/251, 256, 258, 269, 166/272, 303, 252, 261

[56] References Cited

UNITED STATES PATENTS

| | | | |
|---|---|---|---|
| 3,167,120 | 1/1965 | Pryor | 166/272 |
| 3,193,008 | 7/1965 | Moore | 166/258 |
| 3,349,846 | 10/1967 | Trantham et al. | 166/258 X |
| 3,360,045 | 12/1967 | Santouriam | 166/272 X |
| 3,402,770 | 9/1968 | Messenger | 166/272 X |
| 3,439,742 | 4/1969 | Durie | 166/272 |
| 3,692,111 | 9/1972 | Breithaupt et al. | 166/272 X |
| 3,768,559 | 10/1973 | Allen et al. | 166/272 |
| 3,872,924 | 3/1975 | Clampitt | 166/272 X |

*Primary Examiner*—Stephen J. Novosad
*Assistant Examiner*—George A. Suchfield
*Attorney, Agent, or Firm*—Carl G. Ries; Thomas H. Whaley; Jack H. Park

[57] ABSTRACT

Disclosed is a method for recovering viscous oil from subterranean, viscous oil containing formations, particularly from shallow formations which overlie water zones. An injection well is completed in the lower part of the oil formation and an equivalent amount in the water zone immediately therebelow, and the production well is completed in the entire oil zone and small amount in the water zone. Heated air is injected into the formation, the air channeling through the upper-part of the water zone and causing an in situ combustion reaction to occur at the oil water contact. Air injection and in situ combustion in the oil water contact heat the oil above by conduction as well as hot gas convection through the oil saturated interval. The injection well is then completed in the upper portion of the formation and the section in the water zone is closed as by cementing, and then steam is injected into the oil saturated interval.

8 Claims, 2 Drawing Figures

METHOD FOR RECOVERING VISCOUS PETROLEUM

BACKGROUND OF THE INVENTION

I. Field of the Invention

This invention concerns a thermal oil recovery method utilizing in situ combustion and steam in a method which permits efficient recovery from shallow formations with continously underlying water zones.

II. Background and Prior Art

There are many subterranean, petroleum-containing formations throughout the world which contain petroleum whose viscosity is so great that essentially no petroleum may be recovered from the formation by conventional primary or secondary recovery means. Some treatment must be applied to the formation in order to reduce the viscosity of the formation petroleum to a sufficiently low value that it will flow through a permeable formation if sufficient pressure differential is applied to the formation to permit recovery of the petroleum.

Numerous means have been described in the prior art and generally are well recognized for treating subterranean formations to reduce the viscosity of viscous petroleum sufficiently that it may be recovered from the formation. Solvent oil recovery methods are effective but very costly because of the high cost and large quantities of solvents required, and the problems associated with leaving appreciable amounts of solvent in the formation after all of the recoverable petroleum have been recovered therefrom. Thermal oil recovery methods have also been effective for reducing the viscosity of viscous petroleum sufficiently so as to enable its recovery. These methods generally involve the injection of a hot fluid, preferably steam or a mixture of steam and some other material, for the purpose of heating oil in order to reduce the viscosity so that it may be displaced from the petroleum formation. In situ combustion has also been utilized successfully in certain oil formations. In situ combustion involves the injection of heated air into the formation for the purpose of initiating a combustive or oxidated type reaction, which can be propagated through the formation. The combustion reaction heats the oil significantly, thereby reducing its viscosity and permitting the flow of heated petroleum to the surface of the earth.

Certain types of formation have not been amenable to either steam flooding or in situ combustion, for a variety of reasons. Shallow formations which overlie essentially continuous water-saturated zones, do not respond readily to conventional thermal oil recovery methods because the injected fluid, either steam or air, tends to channel into the lower water-saturated zone. Even though the air or steam injection well may be completed only in the oil saturated inverval, the injected fluid quickly travels through the path of least resistance, which will involve passing into the water saturated zone where no heating of petroleum occurs because the steam or combustive reaction front will bypass the majority of the oil saturated interval.

In view of the foregoing discussion, it can be readily appreciated that there is a substantial need for a method for recovering viscous petroleum from viscous petroleum-containing formations overlying a water saturated zone.

SUMMARY OF THE INVENTION

My invention involves a two-step thermal recovery method, in which the injection well is first completed with a small amount, i.e., from 5–25 percent of the thickness of the oil formation in the bottom of the oil-saturated zone and essentially an equal amount in the top of the water saturated zone. The production well is completed throughout the entire oil-saturated zone and a small amount, i.e., around 5% or so of the thickness of the oil formation in the top of the water-saturated zone. Air is injected into the formation at the oil-water contact via the injection well and heat is applied so as to initiate an in situ combustion reaction at the oil-water interface. The combustion zone is confined to a thin region of the formation along the oil-water interface, and very little oil recovery is effected during the in situ combustion phase. Heat generated by the in situ combustion reaction heats the viscous oil immediately thereabove. Gaseous products of combustion as well as heated air move readily through the low permeability viscous petroleum-saturated interval and result in increasing fluid conductivity of the petroleum saturated interval.

Next, the portion of the injection well which is a fluid communication with the top portion of the water saturated interval is closed-off, by cementing or other appropriate means, and the performations or other fluid communication means in the injection well are extended upward into the top of the oil saturated zone so that the injection well is in fluid communication with essentially the entire oil saturated zone. The portion of the production well which was initially in fluid communication with a minor portion of the top of the water saturated interval is similarly closed-off, usually by cementing or other conventional means. A heated fluid, preferably steam or a mixture of steam and a low molecular weight normally gaseous hydrocarbon solvent, is then injected into the injection well to pass through the viscous petroleum saturated formation. Steam injectivity is substantially greater than it would have been prior to the in situ combustion phase because the temperature of the petroleum has been increased and as a result thereof the viscosity of the petroleum has been decreased substantially. The burned out section of the formation along the original oil water contact will be resaturated with water if the aquifer is sufficiently active; otherwise, the burned out area may be filled with water in order to prevent the injected steam from channeling through the burned out area.

DESCRIPTION OF THE PREFERRED EMBODIMENTS

Basically, the process of my invention involves a two-stage thermal oil recovery method in which first heated air is injected at or near the oil-water contact by means of a well completed about equally in the bottom of the oil zone and top of the water zone, so as to initiate and propagate an in situ combustion reaction radially at the oil-water interface. Some oil will be displaced by this process, since the injected air will sweep a portion of the overlying petroleum saturated interval, but will be confined to a relatively thin zone at the oil-water interface of the formation. The combustion reaction generates appreciable heat which raises the temperature of the petroleum contained in the petroleum saturated zone above which is not involved in the combustion reaction. Heat transfer is by conduction and convection by gaseous products of combustion and/or reacted air which are heated in the zone and move upward into the petroleum saturated interval more freely than would a liquid medium. The gaseous materials move exclusively upward because of the effect of gravity, and so a substantial amount of the heat generated in the thin combustion zone is transferred to the overlying petroleum saturated interval. In the second phase, the portion of the injection well originally in fluid communication with the water saturated zones is sealed-off and perforations or other fluid communication means are established throughout the entire petroleum saturated interval in the injection well. Similarly, the small portion of the production well which was originally in fluid communication with the top of the water saturated interval is closed by cementing or other means, and the perforations originally made throughout the entire oil-saturated interval are left open. Steam or a mixture of steam and other materials such as low molecular weight volatile solvents including propane or butane are then injected into the injection well, with the result that the steam moves more readily through the preheated oil-saturated interval than it would have done prior to the first heating phase, since the viscosity of the viscous petroleum has been reduced considerably by the effects of heating by the in situ combustion phase.

Figure 1:
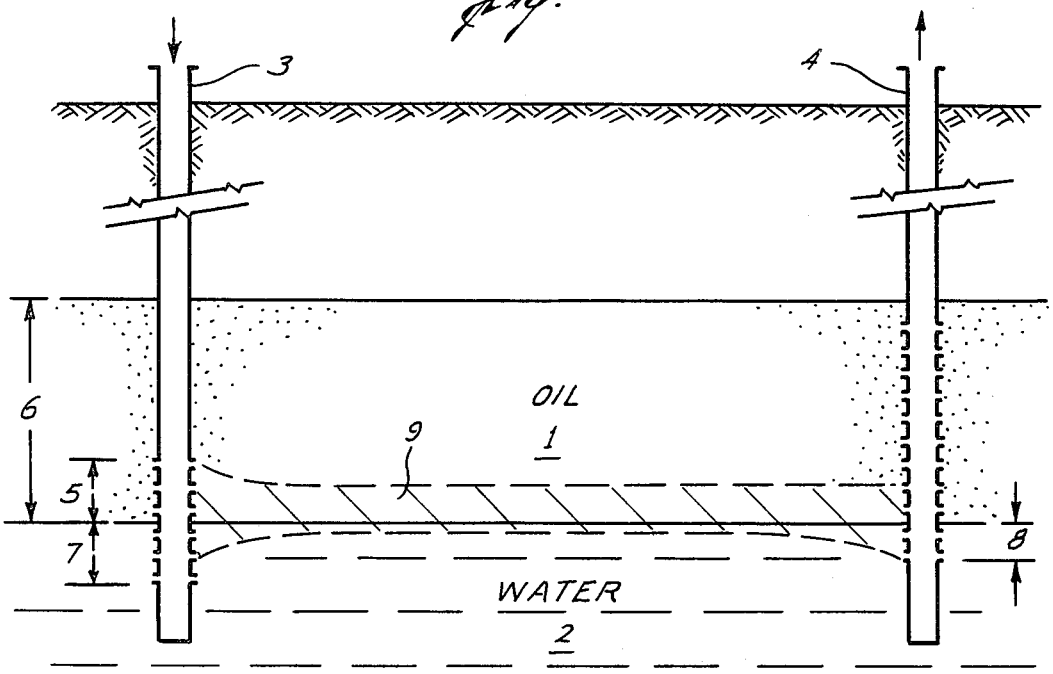
FIG. 1 illustrates in cross-sectional view a subterranean viscous petroleum-containing formation overlying a water saturated zone to which the process of my invention is being applied, showing the method of completing the wells and the results of the first phase of the process of my invention, the in situ combustion at the oil water interface stage.

The process may be more readily understood by referring to the attached FIG. 1 in which oil saturated interval 1 overlies water saturated interval 2, which is essentially continuous along the bottom of the portion of the oil-saturated interval to be exploited by means of the subject process. Wells 3 and 4 are drilled through the petroleum saturated zone. Well 3 which is to serve as a thermal fluid injection well, is completed generally as shown in the attached figure. Ordinarily, the distance in which the perforations are formed above the oil water contact designated as 5 in FIG. 1 is from about 5 to about 25 percent of vertical thickness 6 of the petroleum saturated formation. Perforations should also be completed in the top of the water saturated zone a distance 7 about equal to distance 5. The production well is completed throughout the entire oil saturated zone plus a distance 8 which will be about 5 to 15 percent of the thickness of the formation 6.

Air is injected into well 3 to enter into the bottom of petroleum saturated interval through the lower perforations and at the same time enter into the water saturated interval through the perforations formed in the top portions thereof. The air will be confined to the interfacial zone between the petroleum saturated interval and the water saturated interval. The reason for the confinement of air to this interfacial zone is the fact that the petroleum saturated interval has a very low in-situ permeability due to the high viscosity of the petroleum contained therein, and so very little air penetration will result. Air will be confined to the top portion of the water saturated interval because of the difference in specific gravity between the injected air and the formation water contained in the water saturated interval.

It will be apparent to persons skilled in the art of in situ combustion oil recovery methods that the rate at which air is injected into the interfacial zone will be substantially less than the rate which one would inject air if it were expected that air would uniformly invade the full thickness of the petroleum saturated interval with the expectation of sustaining an in situ combustion reaction throughout an appreciable portion of the vertical thickness of the petroleum saturated interval. Since there is an optimum linear rate at which air should pass through even a thin petroleum saturated zone for the purpose of maintaining a stable in situ combustion reaction, the air flux rate, or the cubic volumes of air injected per unit of time will necessarily be smaller since the cross-sectional area of the zone in which the combustion front will be sustainable will be much smaller than would be the case if the entire formation were involved in the combustion. Ordinarily, the air injection rate will vary with the formation thickness, depth, oil saturation and gravity.

Another difference exists between the in situ combustion reaction as applied in the present process and that normally applied in horizontally moving combustion zones for conventional oil recovery purposes. Once the temperature at the production well begins to rise in an ordinary in situ combustion application, it can be assumed that the combustion front is sufficiently near to the production well that further injection of air may be discontinued if indeed it was not deliberately discontinued prior to the first thermal indication of proximity of the combustion front. In the present case, the air spreads rather rapidly across the top of the water saturated interval, and the combustion zone moves quickly across the interval. Air injection may be continued past the point where the first sign of the temperature increase occurs at the production well, which temperature increase will only occur at a point in the production well near the oil water contact. The combustion zone will slowly move in an upward direction as air is continually injected into the formation in the vicinity of the oil water interface, and gaseous components including the unreacted air as well as the products of combustion move in a horizontal direction, generally orthagonal to the direction of movement to the combustion front. The injection of air could be continued more or less indefinitely until the combustion front had moved up into the upper portion of the formation, although the oil recovery efficiency in this instance would not be especially high since the displacement characteristics of a conventional horizontally moving in situ combustion front would not be present in the present situation to aid in recovering petroleum. Ordinarily, it is sufficient to continues injection of air for the purpose of sustaining the in situ combustion reaction in the oil-water interface for a period of time sufficient to raise the temperature in the central or upper portion of the petroleum saturated interval to a level at which the formation petroleum viscosity will be in the range from about 10 to about 100 centipoise.

The duration of the in situ combustion heating phase of my process can be calculated using standard heat flow procedures. It is generally satisfactory to heat the oil formation to a temperature of at least 200° F and preferably at least 300° F. A monitor well can be drilled between wells 3 and 4 to measure the temperature in the upper portion of the petroleum saturated interval between the injection well and the production well. This information is utilized to determine the end point of the first phase of the process of my invention. If the depth of the formation makes this impossible, it is generally satisfactory to continue injection of air for the purpose of sustaining the in situ combustion reaction for a period of time from about 180 to 360 days after the first occurrence of a temperature increase is observed in the production well in the oil water interface. Ordinarily, the thicker oil formation will require the longer period of in situ combustion in order to heat all of the petroleum contained in the formation to a temperature sufficiently high that the viscosity will be reduced in order to increase the mobility of the oil throughout the full thickness of the formation before the second phase of the process of my invention is applied.

It is usually desirable that the burned out area 9 which results from the application of the process of my invention be saturated with water in order to prevent the formation of a thief zone which would defeat the effective application of the steam injection stage of the process of my invention. If the water saturated interval is a sufficiently active aquifer, the water will migrate upward to saturate any burned out area immediately thereabove, and no additional treatment is needed. If this is not the case however, it is necessary to inject water into wells 3 until water is being produced from well 4 in sufficient quantity to insure that the burned out area 9 has been fully saturated with water.

Figure 2:
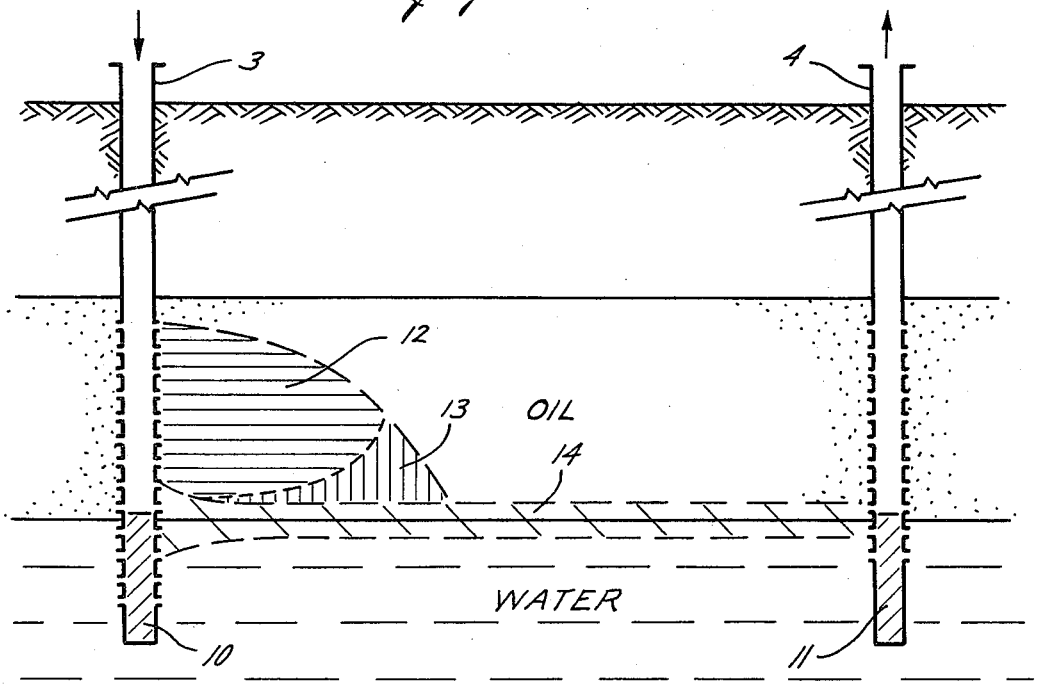
FIG. 2 illustrates in cross-sectional view essentially the same subject as is shown in FIG. 1, except the changes in completion of the injection well and production well are illustrated and the results of application of the second phase of the process of my invention is illustrated.

After completion of the first phase of the process of my invention, involving in situ combustion in the interfacial zone between the petroleum saturated interval and the water saturated interval, and the resaturation of the burned-out zone if needed as described above, the second phase of the process of my invention can be applied. It is necessary to alter the fluid communication in both wells prior to the second stage of the process of my invention. As is shown in FIG. 2, the perforations in the lower portion of both wells, those being in the water saturated interval, should be closed-off by any convenient means. One especially convenient method of accomplishing this is to spot sufficient cement 10 and 11 in the lower portion of the wells so as to completely fill and block-off communications between the wells and the water saturated interval. Sufficient time should be allowed after the cementing operation to insure that the cement is thoroughly set although oil field cements will generally cure in a relatively short period of time, i.e., 24 hours or so being generally sufficient for this purpose.

Perforations should be formed above the perforations originally formed in the injection well, so as to establish relative uniform fluid communication between the injection well and the entire vertical thickness of the petroleum saturated interval. Such perforation may, of course, have been formed initially and closed-off by suitable means, but it is generally preferable to simply delay making the upper perforations until the beginning of the second phase of the process of my invention. It is essential that fluid communication be established in a relative uniform fashion over the entire thickness of the petroleum saturated interval adjacent the injection well, prior to the initiation of the steam injection phase in order to insure that the optimum displacement occurs in the formation.

Steam or a mixture of steam and a low molecular weight, normally gaseous hydrocarbon solvent injection is then initiated in injection well 3. Either superheated or saturated steam may be used, but generally economics dictates that saturated steam be utilized. It is generally satisfactory to use steam in the quality range from about 40 to 100 percent. Steam injection results in further heating of the viscous petroleum in the formation above the zone in which the in situ combustion has been initially applied, and results in there being a steam saturated zone 12 in FIG. 2, and a hot condensate zone 13 in front of and below the steam saturated zone. Gravity generally insures that the steam condensate occupies the lower portion of the permeable formation in which the steam is injected, and so aids in effective sweep since the hot condensate saturated zone is immediately above the water-saturated burned out zone 14.

Steam injection should be continued in this second phase until water breaks through at the production well, as is normally done in a conventional throughput steam flooding operation. Alternately, steam injection may be discontinued at some point prior to the breakthrough of steam or steam condensate at the production well and unheated water injected to displace the steam already present in the formation as well as hot condensate toward the production well. Once sufficient heat has been introduced in the formation in the form of steam so as to insure that the steam saturated zone has moved to a point approximately midway between the injection well and the production well, the thermal efficiency of the process can be improved by terminating steam injection and injecting surface ambient temperature water into the formation to displace the steam and hot steam condensate toward the production well.

FIELD EXAMPLE

By way of additional disclosure but without intending that it be in any way limitative or restrictive of my invention, the following field example is offered.

A viscous oil deposit is located at a depth of 1000 feet and it is determined that the thickness of a deposit is 45 feet. The deposit overlies an aquifer that extends relatively continuously under the viscous oil deposit. The viscosity of the petroleum contained in the formation is about 300 centipoise at the formation temperature 105° F. There is no gas cap and no solution gas in the petroleum formation and essentially no petroleum can be recovered by primary means. The porosity of the oil formation is 30 percent. The high oil viscosity and low in situ permeability in the formation, about 50 millidarcies, indicate that the formation would not be suitable for waterflooding or direct steam exploitation because of the low permeability.

Two wells are drilled into the formation 330 feet apart and extending approximately 20 feet below the petroleum saturated interval. Perforations are formed in the injection well from a point about 10 feet above the oil-water contact to a point about 10 feet below the oil-water contact so the 20 foot perforated interval is located about one-half in the petroleum saturated zone and one-half in the water saturated zone. The production well is perforated from the top to the bottom of the petroleum saturated zone plus about 5 feet into the water saturated zone. For the purpose of the additional pilot field experiment, a third well is drilled into the upper third of the petroleum saturated zone for purposes of monitoring the temperature in the upper portion of the petroleum formation during the course of the in situ combustion phase of the process of my invention. Thermocouples are installed in the monitor well.

A gas fired burner is located in the injection well at a point about even with the oil water contact and air injection is initiated into the injection well at an average rate of 750,000 standard cubic feet per day. The gas fired burner is operated for the first 10 days of air injection in order to ensure that a substantial zone of combustion has been initiated in the formation, after which further heating of the air is unnecessary since the combustion reaction is self-sustaining and self-propagating throughout a thin interval in the oil water contact zone. Injection of air is continued and the temperature in the monitor well is observed, and after 60 weeks of air injection it is determined that the temperature in the upper portion of the petroleum saturated interval at a point about equal distance between the injection and the production well has reached about 250° F, at which temperature the viscosity of the heavy oil in the formation has been reduced to a value less than 10 centipoise.

The lower portion of each of the two wells in fluid communication in the formation are cemented to a point about equal to the original oil water contact in the formation, thereby closing off the perforations in the water zone of the formation. It is determined that the aquifer underying the petroleum formation is sufficiently active that the burned out region in the formation has been resaturated with water, so water injection is not necessary in this formation.

Steam generators are located adjacent the injection well and 80 percent quality steam at a temperature of 545° F is injected into the injection well at a pressure of 1000 pounds per square inch gauge. The production well is maintained open to the atmosphere. After about 390 days of steam injection, an increase in oil production is noted at the production well, and the oil production continues to increase for 2790 days and levels off thereafter. Steam injection is continued into the injection well until the water-oil ratio of fluid being produced from the production well rises to a value of about 35, which indicates that steam condensate has broken through at the producing well and substantially all of the oil which is recoverable by this program has been recovered. Standard reservoir engineering measurement indicates that approximately 80 percent of the oil originally in place in the formation within the area swept by the injected fluid has been recovered from the formation by application of this process.

Thus I have in the foregoing discussion disclosed how viscous oil overlying a water saturated zone may be recovered from a relatively shallow formation in an efficient manner by thermal means without the normal problem associated with channeling through the water saturated zone underlying the oil formation. While my invention has been described in terms of a number of illustrative embodiments it is not so limited since many variations thereof will be apparent to persons skilled in the art of thermal oil recovery without departing from the true spirit and scope of my invention. It is my desire and intention that my invention be limited and restricted only by those limitations and restrictions which appear in the claims appended hereinafter below.

I claim:

1. A method for recovering viscous petroleum from a subterranean, permeable, viscous petroleum-containing formation overlying and in contact with a water-saturated formation, said petroleum formation being penetrated by at least two wells which penetrate the water-saturated zone by a distance equal to at least 10% of the thickness of the petroleum-containing zone, comprising:

a. establishing fluid communication between the first well and the bottom 5–25 percent of the petroleum-containing zone and a similar distance into the water-saturated zone;

b. establishing fluid communication between the second well and the full thickness of the petroleum-containing zone plus a distance into the top of the water-saturated zone equal to from about 5 to 15 percent of the thickness of the petroleum-containing zone;

c. injecting heated air into the first well to establish an in situ combustion reaction at the point of contact between the bottom of the oil-containing zone and the top of the water-saturated zone;

d. continuing injection of air into the bottom of the oil-containing zone and the top of the water-saturated zone until the temperature in the petroleum formation above the zone in which the combustion reaction is occurring has been raised to at least 200° F.

e. thereafter closing off the fluid communication between the injection well and the production well in the water-saturated zone;

f. establishing fluid communication in the injection well throughout the full thickness of the petroleum-containing zone; and g. injecting steam into the injection well and producing petroleum from the production well.

2. A method as recited in claim 1 wherein water is injected into the formation at a point about equal to the original oil-water contact after completion of the in situ combustion phase to resaturate the burned out zone.

3. A method as recited in claim 1 wherein the fluid communication means between both wells and the water saturated zone are closed-off by filling the zones with cement after completion of the in situ combustion phase.

4. A method as recited in claim 1 wherein the steam injected into the injection well is superheated steam.

5. A method as recited in claim 1 wherein saturated steam is injected into the injection well.

6. A method as recited in claim 1 wherein a mixture of steam and a low molecular weight, normally gaseous hydrocarbon are injected into the injection well.

7. A method as recited in claim 1 comprising the additional step of penetrating the upper third of the petroleum-containing formation with a temperature monitoring well located between the injection well and the production well, monitoring the temperature in the upper third of the formation by temperature measuring devices located in the temperature monitoring well, and terminating injection of air into the formation when the temperature in the upper third of the petroleum formation has risen to a value of at least 200° F.

8. A method as recited in claim 1 wherein air injection for in situ combustion is continued until the temperature in the petroleum-containing formation above the zone of in situ combustion has been raised to a value of at least 300° F.

* * * * *